United States Patent [19]

Guslits

[11] Patent Number: 4,797,703

[45] Date of Patent: Jan. 10, 1989

[54] MECHANISM FOR LOCATING A FLEXIBLE PHOTOCONDUCTOR RELATIVE TO A PLURALITY OF DEVELOPMENT STATIONS

[75] Inventor: Vladimir S. Guslits, Rochester, N.Y.

[73] Assignee: Eastman Kodak Company, Rochester, N.Y.

[21] Appl. No.: 135,861

[22] Filed: Dec. 21, 1987

[51] Int. Cl.[4] ..... G03G 15/06; G03G 15/01

[52] U.S. Cl. ..... 355/3 DD; 355/3 BE; 355/10; 355/4; 118/661; 118/645

[58] Field of Search ..... 355/3 DD, 3 BE, 16, 355/10, 4, 3 R; 118/645, 656, 657, 658, 661

[56] References Cited

U.S. PATENT DOCUMENTS

| | | | |
|---|---|---|---|
| 3,893,417 | 7/1975 | York | 355/10 X |
| 3,974,952 | 8/1976 | Swanke et al. | 226/189 |
| 4,013,041 | 3/1977 | Armstrong et al. | 118/656 |
| 4,361,112 | 11/1982 | Di Nallo et al. | 355/10 X |
| 4,398,496 | 8/1983 | Kopko | 355/3 DD |
| 4,410,260 | 10/1983 | Kuehnle | 355/3 BE |
| 4,454,833 | 6/1984 | McChesney et al. | 118/661 |
| 4,537,494 | 8/1985 | Lubinsky et al. | 355/3 BE |
| 4,565,437 | 1/1986 | Lubinsky | 355/3 DD |
| 4,575,217 | 3/1986 | Bothner | 355/3 DD |
| 4,630,919 | 12/1986 | Fantuzzo et al. | 355/3 BE |
| 4,641,946 | 2/1987 | Forbes | 355/3 DD |
| 4,686,936 | 8/1987 | Chow | 118/661 |
| 4,699,500 | 10/1987 | Lubberts et al. | 355/4 |
| 4,723,144 | 2/1988 | Silverberg | 355/3 DD |
| 4,733,273 | 3/1988 | Lloyd | 355/10 |

OTHER PUBLICATIONS

*Xerox Disclosure Journal*, vol. 7, No. 3, May/Jun. 1982, pp. 199–201.

*Research Disclosure*, Jun. 1979, Item No. 18272, pp. 347–348.

*Primary Examiner*—R. L. Moses

*Attorney, Agent, or Firm*—Tallam I. Nguti

[57] ABSTRACT

Two development stations each have fixed stops at a predetermined position relative to a toning roller. The stations develop latent images on one surface of a flexible photoconductor, and two parallel rollers are located adjacent the other surface of the photoconductor. One roller or the other roller can deflect the photoconductor into an operative relationship with one or the other of the stations. The apparatus that moves the rollers engages the stops to precisely locate the photoconductor relative to the stations.

4 Claims, 2 Drawing Sheets

MECHANISM FOR LOCATING A FLEXIBLE PHOTOCONDUCTOR RELATIVE TO A PLURALITY OF DEVELOPMENT STATIONS

BACKGROUND OF THE INVENTION

This invention relates to a mechanism for locating an endless photoconductor relative to magnetic brushes of development stations adjacent a path for the photoconductor.

U.S. Pat. No. 3,974,952 entitled Web Tracking Apparatus issued on Aug. 17, 1976 in the names of T. Swanke et al. The apparatus disclosed in that patent includes a pair of spaced, fixed plates for supporting a plurality of rollers. An endless flexible photoconductor is carried by the rollers and advanced past a series of stations, including a single development station that is outside the endless loop formed by the photoconductor. A series of back-up rollers between the plates are located inside the loop formed by the photoconductor and opposite the development station to help establish the plane of the photoconductor relative to the development station.

Apparatus as generally described above has been used successfully in prior copiers/duplicators. In one such copier/dupicator, as the development station is moved into place relative to the photoconductor, the toning roller of a magnetic brush apparatus is located with respect to the back-up roller (and thus the photoconductor) by a four-point mounting including a guide. This system has several disadvantages. For example, the four point system is an over restrained system, it does not always provide the required accuracy of alignment relative to the back-up rollers and photoconductors, and it makes removal of the station difficult. In another copier/duplicator the development station moves into position in a tray and adjustments are provided to move the toning roller with respect to the photoconductor and the back-up roller. These prior systems work satisfactorily even though the back-up roller, toning roller and photoconductor may not be precisely located with respect to each other, especially in a front-to rear direction (i.e., laterally relative to the photoconductor). However, new development stations for an improved developer material require more accuracy in establishment of the plane of the photoconductor with respect to the toning rollers. Thus, improved mechanisms are needed to meet this requirement.

Sometimes a reproduction apparatus is provided with two or more development stations for developing latent images with toner particles of two or more colors. In order to develop each latent image on a photoconductor with toner particles of only one color, the development stations can be moved alternately toward and away from the photoconductor. However, the stations are heavy, and the mechanisms for moving them must be able to operate fast and accurately for satisfactory development of the images. Movement of the stations may be necessary for a rigid drum type photoconductor, but when the photoconductor is flexible, it is clearly more desirable to move the photoconductor relative to the stations.

SUMMARY OF THE INVENTION

Accordingly, it is an object of the invention to improve the accuracy of alignment of a flexible photoconductor relative to a development station, especially in a lateral direction relative to the photoconductor. Another object is to provide accurate positioning of the photoconductor relative to the development station while avoiding an over restrained system and without complicating removal of the development station. A further object of the invention is to provide accurate positioning of a flexible photoconductor along the length of each of a plurality of stationary development stations. The present invention relates to an improvement in a reproduction apparatus having a flexible photoconductor trained about a plurality of rollers for movement along a path. The photoconductor has first and second surfaces with the first surface being adapted to have latent images formed thereon. First and second development stations are positioned along the path adjacent the first surface of the photoconductor for applying developer material to the latent images thereon. A mechanism deflects the photoconductor into a position for receiving developer material from the first station or the second station. The mechanism includes means defining two spaced stops on each of the development stations. First and second back-up rollers are located adjacent the second surface of the photoconductor, and the rollers are spaced from each other. The rollers are mounted for conjoint movement about an axis located between the rollers. Means are provided for moving the back-up rollers between (1) a first position wherein the first roller engages and deflects the photoconductor into a position relative to the first development station to permit developer material from such stations to be applied to a latent image on the photoconductor, and (2) a second position wherein the second roller engages and deflects the photoconductor into a position relative to the second development station to permit developer material from the second station to be applied to a latent image on the photoconductor. Means associated with the mounting means limits movement of the back-up rollers. The limiting means comprises first means on the mounting means engagable with the stops on the first development station when the back-up rollers are moved to their first position and second means on the mounting means engageable with the stops on the second development station when the back-up rollers are moved to their second position.

BRIEF DESCRIPTION OF THE DRAWINGS

In the detailed description of the preferred embodiment of the invention presented below reference is made to the accompanying drawings, in which.

DETAILED DESCRIPTION OF THE INVENTION

Figure 2:
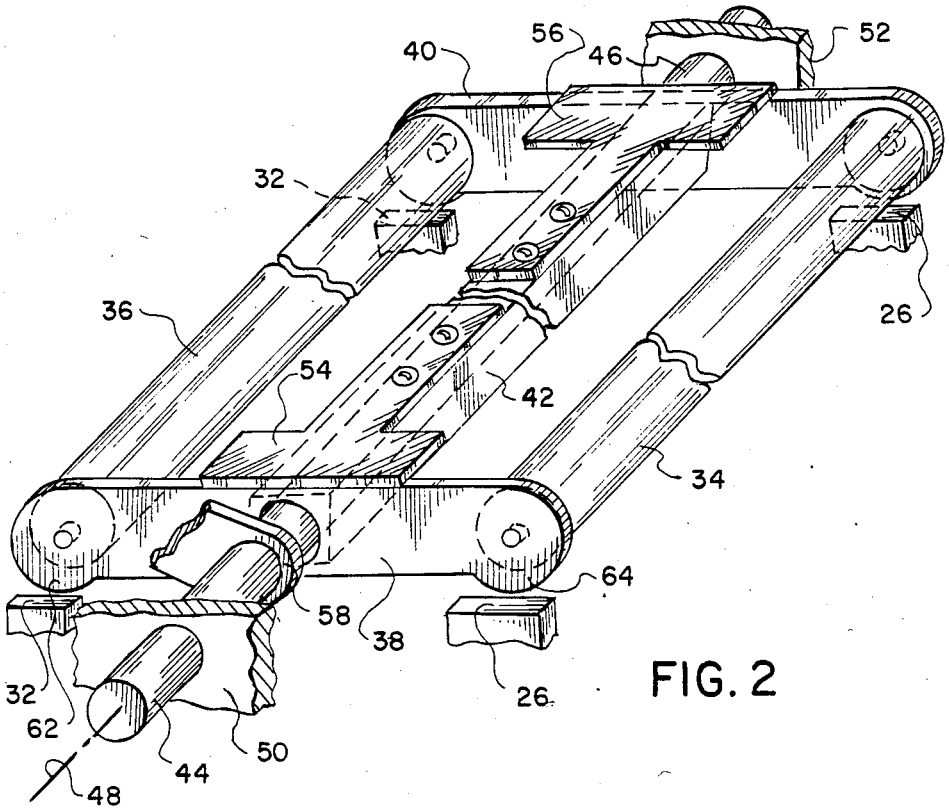
FIG. 2 is an enlarged perspective view of a portion of the FIG. 1 apparatus.

The mechanism of the invention can be used with a reproduction apparatus, a portion of which is illustrated in the drawings and generally designated 10. Apparatus 10 can be, for example, an electrographic copier/duplicator as generally disclosed in the before mentioned U.S. Pat. No. 3,974,952, the disclosure of which is incorporated herein by reference. The reproduction apparatus comprises a photoconductor 12 that is supported for movement along an endless path by a plurality of rollers, two of which are shown at 14 and 16. The lower surface of the photoconductor, as viewed in the drawings, is adapted to receive a latent image that is developed, transferred to a receiver sheet, such as a copy sheet, and fused to the receiver sheet.

As the photoconductor moves between rollers 16 and 14, it passes above a pair of development stations generally designated 18 and 20. Two or more development stations are used in reproduction apparatus for various reasons. For example, station 18 may be used for applying to the latent image on the bottom surface of photoconductor 12 a developer material comprising carrier particles and toner particles with a pigment therein that will produce black images on the ultimate copy sheet. Similarly, station 20 can be used to provide developer material having toner particles of a different color, for example, red, green, etc. Alternatively, three or four toning stations can be used for producing so called full process color electrographic prints. Both stations are illustrated as magnetic brush development stations having toning rollers as the applicator.

Station 18 comprises a toning roller 22 which is located within a housing 24 having a pair of stops 26 (FIG. 2) located directly below the plane of photoconductor 12. One stop 26 is laterally beside the path of the photoconductor 12. Similarly, station 20 comprises a toning roller 28 that is located within a housing 30 having a pair of spaced stops 32 located beneath and laterally beside the path of photoconductor 12. The stops of each station are at predetermined, fixed locations relative to the respective toning roller. As explained in more detail later, the stops provide reference points at a fixed location relative to the toning rollers which are used for locating the photoconductor relative to the toning rollers. Stations 18 and 20 are movable on tracks (not shown), for example, into and out of an operative position within the reproduction apparatus. During such movement the portion of photoconductor 12 above stations 18, 20 occupies a position illustrated in FIG. 1 where it is in a plane between the bottom of rollers 14, 16. In this plane it is spaced above the toning rollers 22 and 28 and other portions of the development station apparatus.

Figure 3:
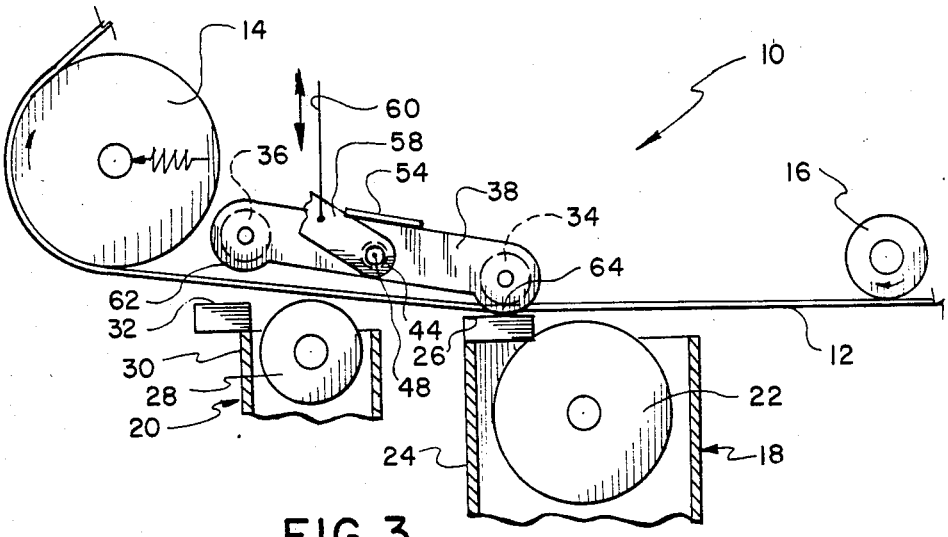
FIGS. 3 and 4 are views similar to FIG. 1 but showing the mechanism of the invention in two different positions for locating the photoconductor relative to the two development stations.
Figure 4:
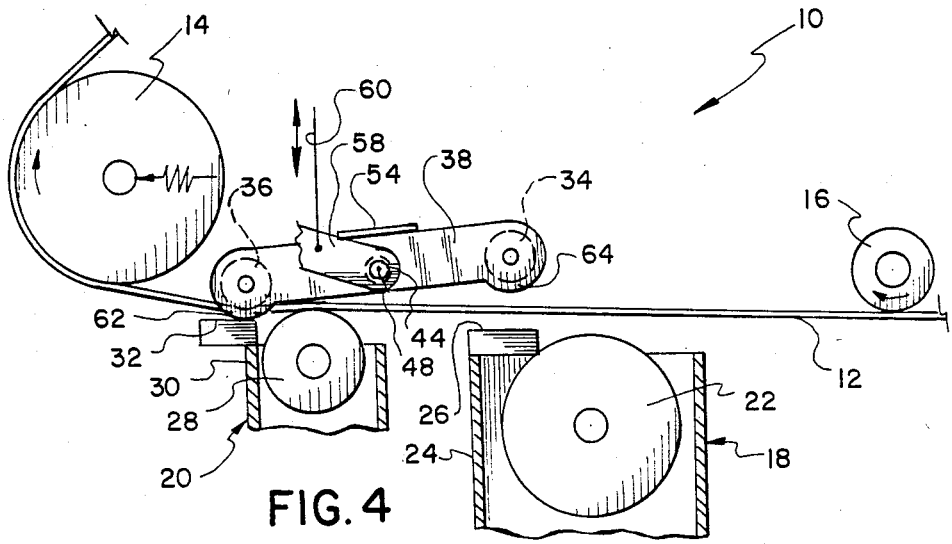

Two back-up rollers 34 and 36 positioned inside the photoconductor are movable toward and away from the inner surface of photoconductor 12 in order to bring the photoconductor into the desired relationship with the stations for development latent images on the photoconductor. The rollers are parallel to each other and to the toning rollers 22, 28. The back-up rollers 34, 36 are located downstream a short distance from the toning rollers 22, 28, respectively, and are between rollers 14, 16 supporting the photoconductor. As shown in FIG. 3 roller 34 is moved downwardly to bring the photoconductor 12 into close proximity with the toning roller 22 of development station 18 in order to develop images from station 18. At the same time, the photoconductor is spaced far enough from the toning roller 28 of station 20 so that developer will not be transferred from that station to the photoconductor. This allows developer to remain on the toning roller of station 20 without being transferred to the photoconductor. In FIG. 4, on the other hand, roller 36 has been moved downwardly into engagement with the photoconductor 12 and roller 34 has moved in the opposite direction. This brings the photoconductor into operative relationship with respect to the station 20 to allow images on the photoconductor to be developed by that station. At the same time, the phtoconductor is moved upwardly away from station 18 sufficiently so that developer on the toning roller 22 of that station will not develop images on the photoconductor. This operation will be explained in more detail later.

The apparatus for moving the back-up rollers between each of these positions is best illustrated in FIG. 2 of the drawings. The rollers 34, 36 are supported from end plates 38 and 40 at the front and rear of the copier/duplicator, respectively. The rollers can either rotate or remain stationary with respect to the plates 38, 40 but preferably are rotatable to minimize scratching of the photoconductor. Positioned between rollers 34, 36 and the end plates 38, 40 is a rectangular bar 42. Secured to the bar at the ends thereof, and projecting through the end plates, are short shafts 44 and 46, which are mounted for rotation about a common axis 48. The shafts are mounted in fixed mechanism plates 50, 52 (FIG. 2) that are beside the photoconductor. Plates 50, 52 can be the fixed plates that support rollers 14, 16 as disclosed in U.S. Pat. No. 3,974,952. Shafts 44 and 46 fit loosely in the end plates 38 and 40 so that the plates can move with respect to the shafts.

Flat, T-shaped springs 54, 56 have their respective base portions secured to opposite ends of the bar 42. The springs are located on the bar so that the top or cross arm portions of the springs bear against the upper edge of plates 38, 40 on both sides of axis 48. Thus rotation of shaft 44 or 46 is transmitted through the bar 42 and the springs 54, 56 to the end plates 38, 40 to thereby urge the rollers 34, 36 to pivot about axis 48 to the positions illustrated in FIGS. 1, 3 and 4. Shaft 44 can be driven in either of two directions by any suitable mechanism. For example, a lever 58 (FIG. 1) can be attached to shaft 44 and coupled by a linkage diagramatically shown at 60 to an actuator, such as a pair of solenoids (not shown), that drive the linkage in opposite directions. Thus one solenoid drives lever 58 clockwise about axis 48, while the other drives the lever counterclockwise.

Plates 38, 40 are adjacent the sides edges of the photoconductor 12. Plate 38 has a pair of arcuate projections 62, 64 at its ends that project beneath the rollers 34, 36. Similar projections are provided on the plate 40. These projections cooperate with stops 32, 26, respectively, to limit pivotal movement of the rollers 34, 36. Stops 32, 26 are part of the stations 18, 20 and thus establish the position of the photoconductor relative to the toning rollers of the stations.

By providing two springs 54, 56, the end plates 38, 40 can act independenly if there is any front-to-rear misalignment of the toning rollers and the photoconductor. Thus the front end plate 38 may pivot a little more (or less) than the rear end of plate 40, as required in order for the projections on both end plate to contact the related stops on the stations. As a result, the photoconductor is accurately aligned with the toning roller in each station at both the front and rear of the station, not just at one end thereof, as in some prior devices.

Figure 1:
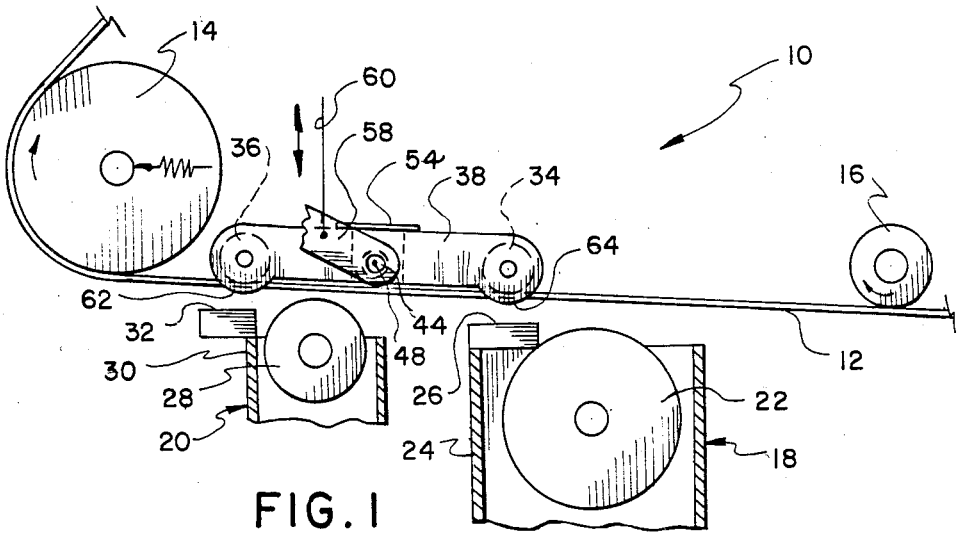
FIG. 1 is an elevation view of a portion of a reproduction apparatus having two development stations and incorporating a preferred embodiment of a mechanism of the invention for locating a back-up roller and photoconductor relative to the applicators of both development stations.

Operation of the apparatus of the invention will not be described. FIG. 1 of the drawings illustrates the position of the parts when neither of the development stations is being used to apply toner to electrostatic images on the bottom surface of the photoconductor 12.

With the parts in this position, stations 18 and 20 can be moved into and out of the reproduction apparatus 10 without interference from the photoconductor or other parts of the apparatus.

When it is desired to apply toner from station 18 to images on the bottom surface of the photoconductor 12, linkage 60 is moved upwardly to swing the lever 58 in a clockwise direction and thereby rotate the shafts 44, 46 about axis 48 in a clockwise direction. Such moves the rollers 34, 36 from the position shown in FIG. 1 to the position shown in FIG. 3. The movement continues until the projections 64 on the plates 38, 40 engage the stops 26 of station 18. At this time the roller 106 is in engagement with the inner surface of photoconductor 12 and urges it downwardly. More specifically, the clockwise rotation of shafts 44, 46 causes corresponding movement of the bar 42. This movement is translated through springs 54, 56 to the end of plates 38, 40 to swing them downwardly until both of the projections 64 contact the stops 26. In this manner roller 34 is exactly positioned with respect to the station 18, and this in turn precisely locates the photoconductor at the desired position above the top of toning roller 22. As this occurs roller 36 moves upwardly away from the photoconductor. The path for the photoconductor from roller 34 to roller 14 is above the position required for development station 20 to apply toner to images on the bottom of the photoconductor. Thus when the parts are in the position shown in FIG. 3 toner can be applied to the latent images only from the station 18.

When it is desired to apply toner from station 20 to latent images on the photoconductor, linkage 60 is moved downwardly to effect counterclockwise movement of lever 58 about the axis 48 of shafts 44, 46. This moves the parts to the position illustrated in FIG. 4. More specifically, rotation of shaft 44, 46 effects rotation of the bar 42. The bar moves springs 54, 56 to bias the end plates 38, 40 in a counterclockwise direction about axis 48 until the projections 62 on both of the end plates contact the stops 32 of station 20. At this time the roller 36 has moved downwardly to deflect the photoconductor from its FIG. 1 position to its FIG. 4 position where it is precisely located with respect to the staion 20 so that toner can be applied from toning roller 28 to the latent images on the photoconductor. Roller 34 is raised out of contact with the photoconductor 10. The path for the photoconductor from roller 16 to roller 36 is above the position required for toner from station 18 to be applied to latent images on the photoconductor. Thus only toner from station 20 is applied to the photoconductor when the parts are in the position illustrated in FIG. 4. When the linkage 60 is released, springs 54, 56 together with the force exerted by the photoconductor on rollers 34, 36, return the mechanism to the position illustrated in FIG. 1 where the photoconductor moves directly from roller 16 to roller 14 along a path that is above both stations 18 and 20 by a distance sufficient to prevent application of toner from either station to the photoconductor.

The apparatus of the present invention provides a simple but highly accurate mechanism for precisely locating the photoconductor with respect to two spaced development stations in a reproduction apparatus. By providing two springs 54, 56 the plates 38 and 40 are independently biased to their positions shown in FIGS. 3 and 4 during operation, thereby assuring that any misalignment between the front and rear of the apparatus is overcome because the springs will allow one end plate to stop while the other continues to travel until it reaches the limit of its movement as defined by the projections 62, 64 and the stops 26, 32 of the development stations. In addition, the mechanism of the invention can be moved between its various positions rapidly and accurately with very little effort.

The invention has been described in detail with particular reference to a preferred embodiment thereof, but it will be understood that variations and modifications can be effected within the spirit and scope of the invention as described hereinabove and as defined in the appended claims.

I claim:

1. In a reproduction apparatus having a flexible photoconductor, means supporting the photoconductor for movement along a path, the photoconductor having first and second surfaces with the first surface being adapted to have latent images formed thereon, and first and second development stations positioned along the path adjacent the first surface of the photoconductor for applying developer material to the latent images thereon, a mechanism for deflecting the photoconductor into a position for receiving developer material from the first station or the second station comprising:

means defining two spaced stops on each of the development stations, first and second back-up rollers adjacent the second surface of the photoconductor, the rollers being spaced from each other, means mounting the rollers for conjoint movement about an axis located between the rollers, means for moving the back-up rollers between (1) a first position wherein the first roller engages and deflects the photoconductor into a position relative to the first development station to permit developer material from such stations to be applied to a latent image on the photoconductor, and (2) a second position wherein the second roller engages and deflects the photoconductor in a position relative to the second development station to permit developer material from the second station to be applied to a latent image on the photoconductor, means associated with the mounting means for limiting movement of the back-up rollers, the limiting means comprising first means on the mounting means engageable with the stops on the first development station when the back-up rollers are moved to their first position and second means on the mounting means engageable with the stops on the second development station when the back-up rollers are moved to their second position.

2. The invention as set forth in claim 1 wherein the mounting means comprises two plates rotatable about the axis, the back-up rollers being supported by the plates, and the limiting means comprising projections on the plates.

3. The invention as set forth in claim 2 wherein the moving means comprises an actuator, and springs between the actuator and the plates for independently urging the back-up rollers toward their respective first position or second position in response to movement of the actuator.

4. In a reproduction apparatus having a flexible photoconductor, means supporting the photoconductor for movement along a path, the photoconductor having first and second surfaces with the first surface being adapted to have latent images formed thereon, and first and second development stations positioned spaced from the first surface of the photoconductor, a mechanism for locating the photoconductor in a position for receiving developer material from the first station or the second station to develop latent images of the first surface, the mechanism comprising:

means defining two spaced stops on each of the development stations, first and second back-up rollers adjacent the second surface of the photoconductor, a pair of plates supporting the back-up rollers in spaced and generally parallel relationship, the plates being adjacent opposite side edges of the photoconductor, means for pivoting the plates and rollers about an axis between the rollers, the pivoting means comprising (a) a member located between the plates and rollers, (b) means for moving the member about the axis in two opposite directions, and (c) springs secured to the member and having portions engageable with the plates for independently urging the plates about the axis when the member is moved about the axis, the pivoting means being effective to move the back-up rollers between (1) a first position wherein the first roller engages and deflects the photoconductor from its path into a position relative to the first development station to permit developer material from such stations to be applied to a latent image on the photoconductor, (2) a second position wherein the second roller engages and deflects the photoconductor from its path into a position relative to the second development station to permit developer material from the second station to be applied to a latent image on the photoconductor, and (3) a third position wherein both rollers are located relative to the photoconductor so that the photoconductor can be moved along its path without images on the photoconductor being developed by the stations, means on the plates (1) engageable with the stops on the first development station when the back-up rollers are moved to their first position and (2) engageable with the stops on the second development station when the back-up rollers are moved to their second position to limit movement of the rollers and photoconductor toward the stations.

* * * * *